US006550453B1

(12) United States Patent
Tian

(10) Patent No.: US 6,550,453 B1
(45) Date of Patent: Apr. 22, 2003

(54) HYDRAULICALLY BIASED PUMPING ELEMENT ASSEMBLY AND FUEL INJECTOR USING SAME

(75) Inventor: Ye Tian, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 61 days.

(21) Appl. No.: 09/667,096

(22) Filed: Sep. 21, 2000

(51) Int. Cl.[7] ..... F02M 37/04
(52) U.S. Cl. ..... 123/446; 123/467
(58) Field of Search ..... 123/446, 500, 123/501, 467, 447

(56) References Cited

U.S. PATENT DOCUMENTS

| | | | | | |
|---|---|---|---|---|---|
| 4,408,586 | A | | 10/1983 | van Rinsum | |
| 4,417,557 | A | | 11/1983 | Walter | |
| 4,449,507 | A | | 5/1984 | Mayer | |
| 4,541,385 | A | | 9/1985 | Eheim et al. | |
| 4,907,555 | A | | 3/1990 | Fuchs | |
| 5,237,968 | A | | 8/1993 | Miller et al. | |
| 5,413,076 | A | | 5/1995 | Koenigswieser et al. | |
| 5,460,329 | A | | 10/1995 | Sturman | |
| 5,537,972 | A | * | 7/1996 | Beck et al. | 123/198 DB |
| 5,662,087 | A | | 9/1997 | McCandless | |
| 5,697,341 | A | | 12/1997 | Ausman et al. | |
| 5,722,373 | A | * | 3/1998 | Paul et al. | 123/446 |
| 5,785,021 | A | | 7/1998 | Yudanov et al. | |
| 5,950,601 | A | * | 9/1999 | Nemoto et al. | 123/495 |
| 5,964,406 | A | | 10/1999 | Zuo | |
| 6,012,644 | A | | 1/2000 | Sturman et al. | |
| 6,026,785 | A | | 2/2000 | Zuo | |
| 6,053,421 | A | | 4/2000 | Chockley | |
| 6,126,412 | A | * | 10/2000 | Smith, III | 417/401 |
| 6,129,072 | A | * | 10/2000 | Graves | 123/446 |

OTHER PUBLICATIONS

Drawing titled "The Sturman Injector" made probably available by Oded E. Sturman on Sep. 20, 1999.

* cited by examiner

*Primary Examiner*—Carl S. Miller
(74) *Attorney, Agent, or Firm*—Liell & McNeil

(57) ABSTRACT

A hydraulically actuated fuel injector includes an injector body that defines an unobstructed biasing passage substantially fluidly isolated from a fuel pressurization chamber. A pumping element is positioned in the injector body and moveable between a retracted position and an advanced position. The pumping element has a biasing surface exposed to fluid pressure in the unobstructed biasing passage, and a fuel surface exposed to fuel pressure in the fuel pressurization chamber. A source of biasing fluid at a working pressure is fluidly connected to the unobstructed biasing passage. A source of fuel fluid at a supply pressure is fluidly connected to the fuel pressurization chamber.

17 Claims, 2 Drawing Sheets

HYDRAULICALLY BIASED PUMPING ELEMENT ASSEMBLY AND FUEL INJECTOR USING SAME

TECHNICAL FIELD

The present invention relates generally to hydraulically actuated pumping element assemblies, and more particularly to the hydraulic biasing of pumping elements in hydraulically actuated devices, such as fuel injectors.

BACKGROUND ART

In one class of fuel injectors, fuel is pressurized to injection levels by a hydraulically driven pumping element. In a typical example, the pumping element includes a relatively large diameter intensifier piston that is acted upon by actuation fluid pressure, such as high pressure lubricating oil, and a relatively small diameter plunger that has one end in contact with fuel in a pressurization chamber. In a typical fuel injection system of this type, a common rail supplies pressurized actuation fluid to a plurality of fuel injectors. Each injector includes a control valve that is opened to initiate an injection event by supplying high pressure actuation fluid to the top side of the intensifier piston. When the control valve is open, high pressure actuation fluid acts on the intensifier piston and drives both it and the plunger downward to pressurize the fuel for the injection event. Between injection events, the plunger and piston are retracted and reset for a subsequent injection event. This retracting is typically accomplished by an appropriate positioning of a compressed return spring or, in some instances, by channeling pressurized fluid to the underside of the intensifier piston.

In order to retract the plunger/piston assembly between injection events using a spring, there is usually a need to add additional parts in order to couple these two components so both retract in unison. One way of accomplishing this is to machine an annular groove on the outer surface of the plunger and couple the plunger to the piston using a ring in contact with a retainer clip that is received in the groove of the plunger.

In the case where pressurized actuation fluid is applied to the underside of the piston to cause the pumping element to retract, some means must be provided for attaching the plunger to the piston. One strategy in this regard is to machine the plunger and piston from a single component. However, this is often undesirable because both the piston portion and the plunger portion must be guided to relatively tight tolerances in different guide bores.

Still another alternative method to retracting the pumping element between injection events is to maintain the fuel at a sufficient pressure that fuel pressure alone refilling the pressurization chamber is sufficient to cause the pumping element to retract. However, this strategy must necessarily require the fuel to be maintained and plumbed around an engine at relatively higher pressures than desirable, and the retraction sequence necessarily requires extensive valving strategies that permit the necessary pressure differentials to cause the pumping element to retract. In all of these retracting strategies, additional components are needed, and assembly problems must be overcome, in order to successfully incorporate one of these retraction strategies into a fuel injector.

Engineers are constantly seeking ways to reduce part count and to improve the ability for an injector to be easily assembled for mass production. The present invention is directed to overcoming these and other problems associated with decreasing part count, increasing injector robustness, and improving the ability of an injector to be easily assembled.

DISCLOSURE OF THE INVENTION

A hydraulically biased pumping element assembly includes a body that defines an unobstructed biasing passage that is substantially fluidly isolated from a pumping chamber. A pumping element is positioned in the body and is moveable between a retracted position and an advanced position. The pumping element has a biasing surface exposed to fluid pressure in the unobstructed biasing passage, and a pressurization surface exposed to fluid pressure in the pumping chamber.

BEST MODE OF CARRYING OUT THE INVENTION

Figure 1:
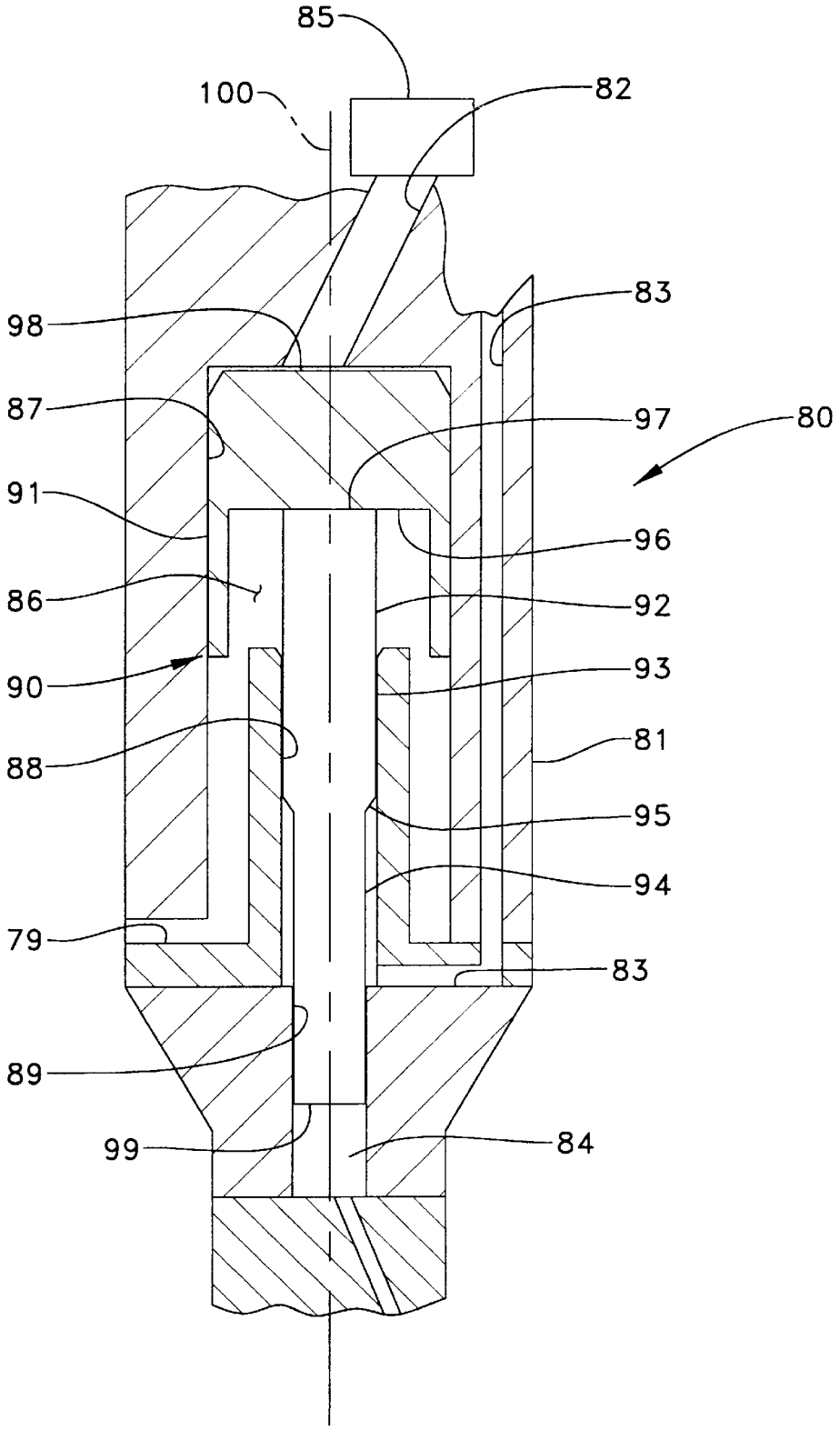
FIG. 1 is a sectioned side diagrammatic view of a pumping element assembly according to the present invention.

Referring now to FIG. 1, a pumping element assembly 80 includes a body 81 that includes one or more components that are machined with internal passageways and attached to one another in a manner well known in the art. Body 81 defines an actuation fluid flow passage 82 that is fluidly connected to a source of high pressure actuation fluid (not shown). A control valve 85 is positioned in actuation fluid flow passage 82 and serves as a means by which a pumping element 90 is activated or deactivated. Pumping element 90 is positioned in body 81 and is moveable between a retracted position, as shown, and a downward advanced position. Pumping element 90 includes an intensifier piston 91 that is guided in a piston bore 87, and a separate and unattached plunger 92 that is guided in an upper plunger bore 88 and a lower plunger bore 89. Thus, plunger 92 and piston 91 are unattached but are in contact with one another where plunger top 97 abuts the underside 96 of piston 91.

Pumping element 90 includes an upper hydraulic surface 98 exposed to fluid pressure in actuation fluid flow passage 82, an underside 96 that is exposed to vapor pressure in vapor pressure chamber 86, a biasing hydraulic surface 95 exposed to fluid pressure in an unobstructed biasing passage 83 and a plunger hydraulic surface 99 exposed to fluid pressure in pressurization chamber 84. The use of the term "unobstructed" is intended to mean that the passage is free of valves or other obstructions that could move or be moved to a position to substantially block the respective passage or otherwise inhibit fluid flow therethrough. In this case, the control valve 85 would be considered to be an obstruction in actuation fluid flow passage 82, preventing the same from being considered "unobstructed" in the context of the present invention. Thus, with regard to unobstructed biasing passage 83, it has one end in fluid contact with biasing surface 95 and an unobstructed flow path connected to a source of pressurized biasing fluid at its other end (not shown). In this case, biasing hydraulic surface 95 is a annular shoulder that separates a large diameter segment 93 from a small diameter segment 94 on plunger 92. Thus, with an ever present biasing hydraulic force acting on surface 95, plunger 92 is maintained in contact with the underside 96 of piston 91. This is accomplished in part because pressure in vapor pressure chamber 86 is maintained relatively low due at least partially to vent 79 that is connected to a low pressure space.

Because plunger 92 and piston 91 are unattached, the structure of the present invention permits some slight misalignment of their common centerline 100 without otherwise altering the function of the invention. In other words, if there were some misalignment between the centers of the respective guide bores, pumping element 90 would still function properly without risk of seizure problems that could otherwise occur due to centerline misalignments.

Figure 2:
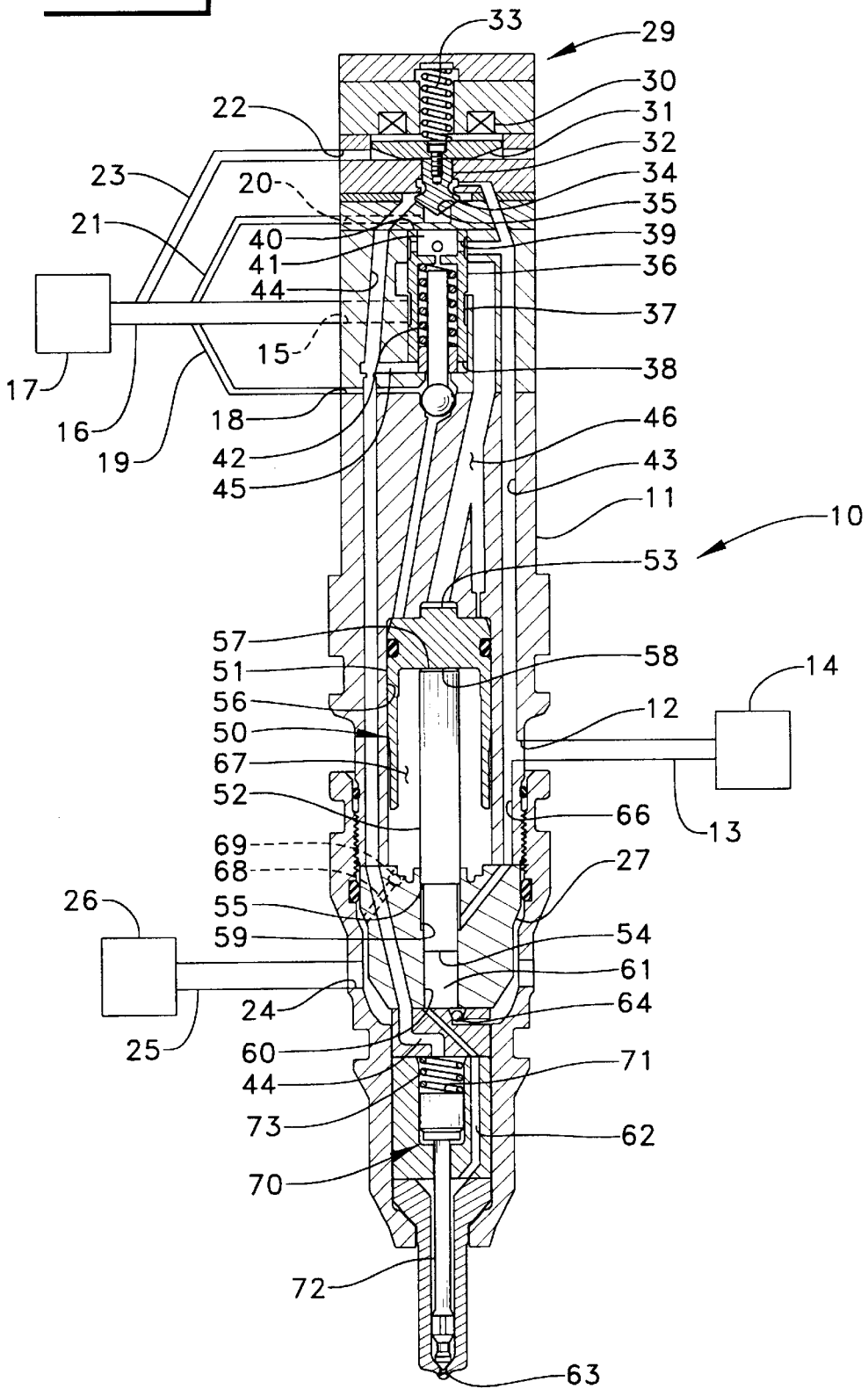
FIG. 2 is a sectioned side diagrammatic view of a fuel injector having a hydraulically biased pumping element assembly according to the present invention.

Referring now to FIG. 2, a hydraulically actuated fuel injector 10 includes an injector body that is made up of various stationary components attached to one another in a manner well known in the art. Injector body 11 defines an actuation fluid inlet 12 that is connected to a source of high pressure actuation fluid 14, such as lubricating oil, via an actuation fluid supply line 13. Injector body also defines a drain passage 15 connected to a low pressure reservoir 17, such as an engine oil sump via a low pressure passage 16. Injector body 11 also defines a pressure relief vent 18, a control pressure vent 20 and an armature cavity vent 22 that are connected to low pressure passage 16 via vent lines 19, 21 and 23, respectively. Finally, injector body 11 defines a fuel inlet 24 connected to a source of relatively low pressure fuel 26, such as distillate diesel fuel, via a fuel supply line 25. In a preferred application, source of fuel 26 is maintained at a relatively low pressure that is greater than the pressure in low pressure reservoir 17 but well below the pressure in actuation fluid source 14.

Fuel injector 10 in controlled in its operation by an electrical actuator 29, which is preferably a solenoid but could be another suitable electrical actuator such as a piezzo electric actuator. Solenoid 29 includes a coil 30 and a moveable armature 31 that is attached to a pilot valve member 32 in a conventional manner. Pilot valve member 32 and armature 31 are biased toward a downward position that closes low pressure seat 35 by a biasing spring 33. When coil 30 is energized, armature 31 and pilot valve member 32 are pulled upward to open low pressure seat 35 and close high pressure seat 34. This upward and downward movement of pilot valve member 32 controls the pressure in a control pressure passage 44. In other words, when pilot valve member 32 is in its downward position closing low pressure seat 35, control pressure passage 44 is fluidly connected to high pressure actuation fluid inlet 12 via internal flow passage 43. When pilot valve member 32 is in its upward position closing high pressure seat 34, control pressure passage 44 is in fluid communication with low pressure reservoir 17 via control pressure vent 20.

While the positioning of pilot valve member 32 controls fluid pressure in control pressure passage 44, the actual flow of high pressure actuation fluid within fuel injector 10 to initiate an injection event is controlled by the positioning of a spool valve member 36. When spool valve member 36 is in its upward position, as shown, an actuation fluid flow passage 46 is fluidly connected to low pressure drain 15 via an annulus 37. When spool valve member 36 is in its downward position, actuation fluid flow passage 46 is fluidly connected to internal flow passage 43 and actuation fluid inlet 12 via an annulus that is positioned adjacent radial openings 39. Spool valve member 36 is normally biased toward its upward position, as shown, by a biasing spring 42. Spool valve member 36 includes or defines a hollow interior 41 that is always fluidly connected to actuation fluid inlet 12 via radial openings 39. As such, top hydraulic surface 40 of spool valve member 36 is always exposed to the high pressure existing in actuation fluid inlet 12. Spool valve member 36 also includes a control hydraulic surface 38 that is exposed to fluid pressure in a branch control passage 45 that is fluidly connected to control passage 44. Preferably, control hydraulic surface 38 and top hydraulic surface 40 are about equal in area such that spool valve member 36 will be hydraulically balanced and biased to its upward position by spring 42 when high pressure exists in branch control passage 45. When pressure acting on the control hydraulic surface 38 is low, by an appropriate positioning of pilot valve member 32, spool valve member 36 will move downward to its lower position against the action of biasing spring 42 due to the high hydraulic force acting on top hydraulic surface 40.

As previously discussed, when spool valve member 36 is in its upward position, as shown, drain passage 15 is fluidly connected to actuation fluid flow passage 46. When spool valve member is in its downward position, actuation fluid flow passage 46 is fluidly connected to high pressure internal flow passage 43. The fluid pressure in flow passage 46 acts upon a top hydraulic surface 53 of a pumping element 50 that is movably positioned in injector body 11. Pumping element 50 is moveable between a retracted position, as shown, and a downward advanced position. Pumping element 50 includes a fuel surface 54 exposed to fuel pressure in a fuel pressurization chamber 61, a biasing surface 55 exposed to fluid pressure in an unobstructed biasing passage 66, a piston underside 58 exposed to vapor pressure in vapor pressure chamber 67 and a top hydraulic surface 53 exposed to fluid pressure in actuation fluid flow passage 46. Because the present invention preferably utilizes two different fluids, one for fuel and one as a working or actuation fluid, unobstructed biasing passage 66 is preferably substantially fluidly isolated from fuel pressurization chamber 61. Because the pressure acting on biasing surface 55 is always about equal to the high pressure at inlet 12, pumping element 50 is biased toward its upward retracted position, as shown.

While it is conceivable that pumping element 50 could be machined from a single solid piece of metal, it preferably includes a separate intensifier piston 51 and plunger 52. By locating biasing hydraulic surface 55 preferably on plunger 52, the plunger top 57 is always biased into contact with the underside 58 of piston 51. This structure permits the invention to function and tolerate some slight misalignment between the common centerlines of plunger 52 and piston 51 without risking seizure problems associated with a unitary pumping element construction. Intensifier piston 51 moves in a relatively large diameter piston bore 56. With each downward movement of piston 51, any liquid that has found its way into vapor pressure chamber 67 is pumped outward via fluid evacuation passage 68 past a check valve 69. In addition, passage 68 ensures that pressure in vapor pressure chamber 67 is about equal to or less than that of the fuel supply pressure.

As with the example illustrated in FIG. 1, biasing hydraulic surface 55 is preferably an annular shoulder that separates an upper larger diameter portion from a lower small diameter portion. These two diametrical portions are preferably guided with a relatively close diametrical clearance in upper plunger bore 59 and lower plunger bore 60, respectively. These two bores are preferably machined in a single chucking on a barrel component 27, which forms a part of injector body 11. As an alternative, a sleeve could be used for the large diameter portion as shown in relation to the example of FIG. 1. When plunger 52 is undergoing its upward retracting stroke, fresh low pressure fuel is drawn into fuel pressurization chamber 61 past a check valve 64.

When plunger 52 is undergoing its downward pumping stroke, check valve 64 closes and high pressure fuel is pushed downward toward nozzle outlet 63 via a nozzle supply passage 62.

The opening and closing of nozzle outlet 63 is controlled by a direct control needle valve 70. The direct control needle valve 70 includes a closing hydraulic surface 71 exposed to fluid pressure in control pressure passage 44, and an opening hydraulic surface located on a needle valve member 72 that is exposed to fluid pressure in nozzle supply passage 62. Direct control needle valve 70 is normally biased to its downward position to close nozzle outlet 63 by a biasing spring 73. This spring strength as well as the expected fluid pressures and the closing and opening hydraulic surface areas of direct control needle valve 70 are preferably such that the same will remain in or move toward its downward closed position when pressure in control pressure passage 44 is high. When pressure in control pressure passage 44 is low, direct control needle valve 70 and its respective surfaces and fluid pressures are preferably such that it will move toward, or remain in its upward open position when fuel pressure in nozzle supply passage 62 is above a valve opening pressure sufficient to overcome the biasing force of spring 73.

Industrial Applicability

Referring again to FIG. 2, fuel injector 10 is shown with its various components positioned as they would be just prior to the initiation of an injection event. In particular, solenoid 29 is de-energized, pilot valve member 32 is in its downward position closing low pressure seat 35, spool valve member 36 is in its upward position, pumping element 50 is in its retracted position, and direct control needle valve 70 is in its downward closed position. When in these positions, high pressure prevails in control pressure passage 44, low pressure prevails in actuation fluid flow passage 46, vapor pressure remains low in vapor pressure chamber 67, and fuel pressure is low in fuel pressurization chamber 61. High pressure prevails in unobstructed biasing passage 66 acting on biasing pressure surface 55. The injection event is initiated by energizing solenoid 29 to lift pilot valve member 32 upward to close high pressure seat 34 and open low pressure seat 35. When this occurs, pressure in pressure control passage 44 quickly drops such that the once high pressure acting on control pressure surface 38 of spool valve member 36 is now low. As such, spool valve member 36 begins moving toward its downward position.

As spool valve member 36 moves downward, it first closes low pressure drain 15 and next opens actuation fluid flow passage 46 to internal flow passage 43 and high pressure inlet 12. When this occurs, the high pressure in flow passage 46 acts upon top hydraulic surface 53 and begins pushing pumping element 50 downward for its pumping stroke. As plunger 52 begins moving downward, check valve 64 closes and the pressure of the fuel in fuel pressurization chamber 61 quickly rises. When the fuel pressure exceeds the valve opening pressure, direct control needle valve 70 lifts to open nozzle outlet to commence the spraying of fuel into the combustion space.

As an aside, those skilled in the art will appreciate that initial injection pressures can be raised and/or some initial rate shaping such as split injections, can be accomplished because of a hysteresis effect in spool valve member 36 relative to that of the relatively quick moving solenoid 29 and pilot valve member 32. In other words, solenoid 29 can be briefly de-energized to re-expose control pressure passage 44 to high pressure to hold direct control needle valve 70 closed as fuel pressure builds beyond the valve opening pressure, and then solenoid 29 can be re-energized before spool valve member 36 has moved sufficiently far to close fluid communication between high pressure internal flow passage 43 and actuation fluid flow passage 46.

During the main portion of the injection event, pumping element 50 continues its downward stroke, direct control needle valve 70 remains in its upward open position, spool valve member 36 remains in its downward position, and pilot valve member 32 remains in its upward position closing high pressure seat 34. Shortly before the desired amount of fuel has been injected, solenoid 29 is de-energized. When this occurs, pilot valve member 32 quickly moves downward to close low pressure seat 35 and re-open high pressure seat 34. This causes pressure in control pressure passage 44 acting on closing hydraulic surface 71 to rise and move direct control needle valve 70 downward to its closed position to close nozzle outlet 63 and end the injection event.

About the same time as direct control needle valve 70 moves downward to its closed position, high pressure prevails on both ends of spool valve member 36, causing it to begin moving upward under the action of biasing spring 42. In order to assist spool valve member 36 in its upward movement, residual pressure in fuel injector 10 above top hydraulic surface 53 acts through a separate pressure relief passage on a pressure relief ball. The pressure relief ball is lifted off its seat and pushes a pin upward into contact with spool valve member 36 accelerating its upward movement. Movement of the pressure relief ball also vents the residual high pressure above piston 51 to low pressure reservoir 17 via pressure relief vent 18. While these events relating to spool valve member 36 are occurring, the pumping element 50 ceases its downward stroke due to a hydraulic locking effect since fuel pressurization chamber 61 becomes a closed volume.

As spool valve member 36 continues moving upward, it eventually closes the fluid communication with fluid flow passage 46 and internal flow passage 43. Shortly thereafter, annulus 37 reopens fluid communication between actuation fluid flow passage 46 and low pressure fluid drain 15. When this occurs, the fluid pressure acting on top of hydraulic surface 53 becomes low, and pumping element 50 begins retracting upward under the hydraulic force acting on biasing hydraulic surface 55. As pumping element 50 retracts, check valve 64 opens to allow fresh low pressure fuel into fuel pressurization chamber 61. On the upward side, the used actuation fluid in actuation fluid flow passage 46 is displaced into low pressure drain 15 toward low pressure reservoir 17 for possible recirculation.

By locating biasing hydraulic surface 55 on a shoulder of plunger 52, several subtle but relatively important advantages can be obtained with the present invention. First, no coupling components are needed between the plunger 52 and piston 51. This allows part count to be reduced, which in turn makes the assembly of fuel injector 10 less problematic. This also improves injector robustness by eliminating any potential problems associated with a return spring. Those skilled in the art will appreciate that the biasing hydraulic surface could be located on piston 51, but some means would need to be provided in order to cause the plunger to retract with the piston between injection events. This alternative might be accomplished by relying upon the relatively low fuel supply pressure only to move the plunger 52 toward its retracted position, but not having the fuel pressure high enough to move the piston and evacuate fluid from actuation fluid flow passage 46 between injection events.

By having a hydraulic surface always exposed to relatively high pressure, the present invention eliminates relatively complicated plumbing and valving schemes of the cited art that use fluid pressure to retract their pumping elements between injection events. The present invention also accomplishes several other important but subtle advantages. For instance, because actuation fluid pressure normally is raised when the fuel injector is operated at rated conditions relative to that of an idle condition, the rate at which the pumping element 50 retracts between injection events increases with the performance demands of the fuel injector as it changes from an idle condition toward a rated condition. This can become important when the time between injection events decreases at the same time that the duration of each injection event increases. In other words, less time is available to reset the injector at rated conditions because the injection events come more frequent and their duration is longer. Thus, the retracting speed of the pumping element 50 naturally increases with the performance demands of injector 10.

Because biasing passage 66 is unobstructed, the energy required to retract pumping element 50 is recovered during each injection event because the fluid below biasing hydraulic surface 55 is simply displaced back toward actuation fluid source 14. This contrasts with many of the cited art hydraulic retracting schemes that must necessarily waste the pressure with each retraction event, which inevitably results in a lower break specific fuel consumption of the engine in which the fuel injector is mounted.

In order for fuel injector 10 to perform similar to its return spring biased counterparts, the top hydraulic surface 53 is preferably made slightly larger by an amount about equal to the area of biasing hydraulic surface 55, so that the performance of the fuel injector remains unaltered. Still another advantage of the present invention is accomplished by manufacturing the pumping element as separate piston and plunger components so that any inevitable slight centerline misalignments due to realistic manufacturing tolerances do not undermine the ability of both piston 51 and plunger 52 to reciprocate in their respective tight clearance bores.

The above description is intended only to illustrate the concepts of the present invention, and is not intended to limit the potential scope of the present invention in any way. For instance, while the biasing hydraulic surface 55 has been shown as being located on the plunger, it could be located on the piston or split between the piston and plunger. Furthermore, while unobstructed biasing passage 66 has been shown as being connected to the high pressure source of actuation fluid, it could be connected to a source of medium pressure biasing fluid as an alternative. In addition, while the present invention has been illustrated in the context of a dual fluid hydraulically actuated fuel injector, the principles of the present invention could be applied to single fluid systems, possibly as a way of simultaneously providing lubrication and a means for retracting the pumping element. In addition, the present invention finds potential application in other hydraulically activated devices, such as engine gas exchange valves.

Thus, those skilled in the art will appreciate that various modifications could be made to the illustrated embodiment without departing from the contemplated scope of the invention, which is defined by the claims set forth below.

What is claimed is:

1. A hydraulically biased pumping element assembly comprising:

a body defining an unobstructed biasing passage substantially fluidly isolated from a pumping chamber;

a pumping element positioned in said body and being movable between a retracted position and an advanced position, and said pumping element having a biasing surface exposed to fluid pressure in said unobstructed biasing passage, and a pressurization surface exposed to fluid pressure in said pumping chamber;

a source of working fluid at a working pressure fluidly connected to said biasing passage;

a source of other fluid at a supply pressure fluidly connected to said pumping chamber; and said working pressure is greater than said supply pressure.

2. The hydraulically biased pumping element assembly of claim 1 wherein said other fluid is different from said working fluid.

3. The hydraulically biased pumping element assembly of claim 1 wherein said pumping element consists essentially of a plunger that is separate from an intensifier piston.

4. The hydraulically biased pumping element assembly of claim 3 wherein said biasing surface is located on said plunger;

said plunger is unattached to said intensifier piston.

5. The hydraulically biased pumping element assembly of claim 1 wherein said pumping element has three segments; and each of said three segments have substantially uniform diameters that are different from one another.

6. The hydraulically biased pumping element assembly of claim 1 further comprising a source of actuation fluid at a working pressure fluidly connected to said unobstructed biasing passage;

a source of other fluid at a supply pressure fluidly connected to said pumping chamber, and said working pressure is greater than said supply pressure;

said pumping element has three segments, and each of said three segments have substantially uniform diameters that are different from one another.

7. A hydraulically actuated fuel injector comprising:

an injector body defining an unobstructed biasing passage substantially fluidly isolated from a fuel pressurization chamber;

a pumping element positioned in said injector body and being movable between a retracted position and an advanced position, and said pumping element having a biasing surface exposed to fluid pressure in said unobstructed biasing passage, and a fuel surface exposed to fluid pressure in said fuel pressurization chamber;

a source of biasing fluid at a working pressure fluidly connected to said unobstructed biasing passage;

a source of fuel fluid at a supply pressure fluidly connected to said fuel pressurization chamber; and said pumping element consists essentially of a plunger that is separate from an intensifier piston.

8. The fuel injector of claim 7 wherein said biasing fluid is different from said fuel fluid; and said working pressure is greater than said supply pressure.

9. The fuel injector of claim 7 wherein said biasing surface is located on said plunger; and said plunger is unattached to said intensifier piston.

10. The fuel injector of claim 7 wherein said pumping element has three segments; and each of said three segments have substantially uniform diameters that are different from one another.

11. The fuel injector of claim 7 wherein said pumping element includes an intensifier piston with a top hydraulic surface exposed to fluid pressure in an actuation fluid passage; and a control valve positioned in said actuation fluid passage, and being moveable between a closed position and an open position.

12. The fuel injector of claim 11 wherein said actuation fluid passage is fluidly connected to said unobstructed biasing passage.

13. A hydraulically actuated fuel injector comprising:

an injector body defining a biasing passage and a fuel pressurization chamber;

a pumping element positioned in said injector body and being movable between a retracted position and an advanced position, and said pumping element having a biasing surface exposed to fluid pressure in said biasing passage, and a fuel surface exposed to fluid pressure in said fuel pressurization chamber; and said pumping element includes three segments, and each of said three segments have substantially uniform diameters that are different from one another.

14. The fuel injector of claim 13 wherein said pumping element consists essentially of a plunger that is separate from, and unattached to, an intensifier piston.

15. The fuel injector of claim 14 wherein said biasing passage is unobstructed and fluidly connected to a source of working fluid.

16. The fuel injector of claim 15 further comprising a source of fuel fluid at a supply pressure fluidly connected to said fuel pressurization chamber;

said source of working fluid is at a working pressure that is greater than said supply pressure.

17. The fuel injector of claim 16 wherein said intensifier piston includes a top hydraulic surface exposed to fluid pressure in an actuation fluid passage fluidly connected to said source of working fluid; and a control valve positioned in said actuation fluid passage, and being moveable between a closed position and an open position.

* * * * *